United States Patent [19]

Fischer

[11] 4,210,268

[45] Jul. 1, 1980

[54] ROTARY STAPLING MACHINE

[75] Inventor: Emil Fischer, Lu-Oggersheim, Fed. Rep. of Germany

[73] Assignee: Albert-Frankenthal AG, Frankenthal, Fed. Rep. of Germany

[21] Appl. No.: 39,010

[22] Filed: May 14, 1979

[30] Foreign Application Priority Data

May 20, 1978 [DE] Fed. Rep. of Germany ..... 2822136

[51] Int. Cl.[2] ..... B27F 7/12

[52] U.S. Cl. ..... 227/81; 227/85; 227/92

[58] Field of Search ..... 227/81, 83, 85, 90, 227/92

[56] References Cited

U.S. PATENT DOCUMENTS

| | | | |
|---|---|---|---|
| 827,700 | 8/1906 | Balze | 227/81 |
| 1,939,666 | 12/1933 | Crofoot | 227/83 |
| 2,420,258 | 5/1947 | Maynard | 227/83 |
| 3,186,617 | 6/1965 | Fischer | 227/81 |

*Primary Examiner*—John McQuade

*Attorney, Agent, or Firm*—Allison C. Collard; Thomas M. Galgano

[57] ABSTRACT

A stapling machine is provided of the type which includes at least one stapling cylinder having a wire transport, a shaped disk which for the formation of the staples bites into a peripheral recess provided in the stapling cylinder, and a fixed staple guide which, with reference to the rotational direction of the stapling cylinder, is positioned after the shaped disk, projects into the peripheral recess and is underrun by the finished staple. The stapling machine is characterized in that the staple guide has, in the area of its surface which is underrun by the back of the staple, a post-bending edge which bites deeper into the recess in the stapling cylinder than does the outer periphery of the shaped disk.

9 Claims, 5 Drawing Figures

IV
IV

ROTARY STAPLING MACHINE

The present invention relates to a stapling machine. More particularly, it relates to a stapling machine of the type having at least one stapling cylinder which, in turn, has at least one wire transport, and a shaped disk associated with the stapling cylinder which, for the formation of the staples, bites into a peripheral recess provided in the stapling cylinder. Also associated with the stapling cylinder is a fixed staple guide which, with reference to the rotational direction of the stapling cylinder, is positioned after the shaped disk so as to bite into the peripheral recess; it being underrun by the finished staple.

When stapling together printed matter it is desirable if the arms of the U-shaped staples are adjusted to turn slightly inwardly. This guarantees a problem-free inward folding process in the area of the closing plate. In arrangements having a fixed stapling horn this is achieved simply by lateral guide rails along which the staple arms are guided and, in so doing, are bent slightly inwardly. In this case, the stapling horn is provided in the region of the guide rails with lateral slots.

In the case of staplers with no stapling horn, of the above-mentioned type and disclosed in DE-PS No. 1,189,562, where the staple is bent by a shaped disk, a solution of this sort is not possible since the staples would no longer be released by a shaped disk undercut in the manner according to the stapling horn slots. For this reason, up to now, the desirable inwardly-directed arm adjustment had to be abandoned in these cases.

It is therefore an object of the present invention to provide, using simple means and avoiding the disadvantages of the known arrangements, a stapling machine of the aforementioned type with no stapling horn, such that staples can be produced with the arms adjusted to turn slightly inwardly so as to thereby guarantee problem-free inward folding of the arms at the closing plate.

According to the invention, this object is achieved in accordance with the present invention in a surprisingly simple manner by the provision of a stapling machine with no stapling horn, of the afore-mentioned type wherein the staple guide has, in the area of its surface which is under-run by the back of the staple, a post-bending edge which bites deeper into the recess in the stapling cylinder than does the outer periphery of the shaped disk. The back of the staple is thereby nicked by the post-bending edge in such a way that the staple arms, being at right angles to the staple back, turn automatically inwardly with their free ends. The measures according to the invention thus make it possible for the first time to attain the desired staple arm adjustment in stapling machines with no stapling horn.

The post-bending edge can expediently be tapered in the direction of deformation, which results in an advantageous manner in a clear bending point in the middle region of the staple back. Due to the post-bending edge being preferably provided with a sloping face, rising in the direction of deformation, the nicking process is advantageously introduced gradually.

A further particularly preferable measure can consist in the depth of penetration of the post-bending edge being adjustable, so that practically every desired degree of deformation can be achieved and, in addition, a non-avoidable amount of wear can in due course be compensated for.

Other objects and features of the present invention will become apparent from the following detailed description, considered in connection with the accompanying drawing, which discloses several embodiments of the invention. It is to be understood, however, that the drawing is designed for the purpose of illustration only, and not as a definition of the limits of the invention.

In the drawing, wherein similar reference characters denote similar elements throughout the several views.

Figures 1, 2, 3, 4, 5:
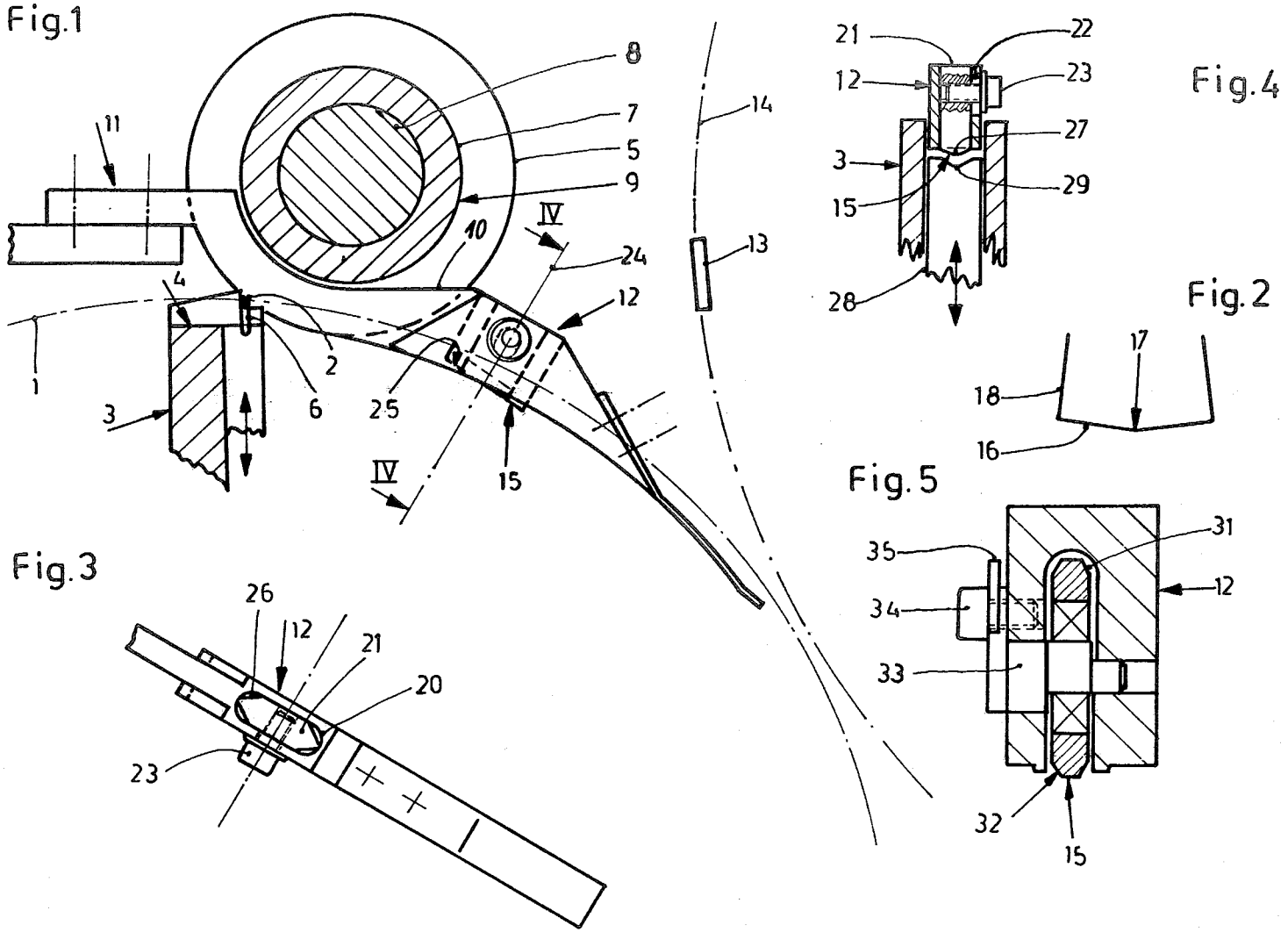
FIG. 1 is a fragmentarily-illustrated side view, partly in section, of a stapling machine embodying the present invention, having no stapling horn and exhibiting a post-bending edge.
FIG. 2 is an end view of a subsequently-bent staple.
FIG. 3 is an end view of a portion of the assembly shown in FIG. 1.
FIG. 4 is a sectional view taken along line IV—IV of FIG. 1.
FIG. 5 is a sectional view through a further embodiment of the invention having a post-bending edge designed as an adjustable disk.

Referring now in detail to the appended drawing, the stapling machine represented schematically in FIG. 1 consists of a stapling cylinder 1 which, for transport of the wire 2 (shown in section and supplied parallel to the cylinder axis), is provided with wire transports 3. Each wire transport 3 has a canal-shaped peripheral recess 4 into which the wire 2 is bent by means of a shaped disk 5; this taking place as soon as the wire transport 3 passes shaped disk 5, the latter being fixed in position. The inside width of the peripheral recess 4 in the stapling cylinder corresponds approximately to the thickness of the shaped disk 5. In the area of the limiting walls of the peripheral recess 4, slots 6 for the wire are provided in which the shaped piece of wire, bent into the peripheral recess 4 by the shaped disk 5, is accommodated and which results in accurate manipulation when the staples are ejected. Shaped disk 5 is rotatably mounted by means of a hub 7 on a frame-locked spindle 8. Disk 5 is provided with a peripheral groove 9 through which projects an arm 10 of a staple guide, generally designated by reference numeral 12, which is held in position at 11 by the frame. Staple guide 12 is positioned, with reference to the rotational direction of stapling cylinder 1, after the shaped disk 5 and it serves to secure or guide the staples, formed by the shaped disk 5, along the path of the wire transport 3 from the point it passes the shaped disk 5 to the point it passes a corresponding closing plate 13; the latter of which is positioned on a folding blade cylinder 14 associated with stapling cylinder 1.

To make sure that the arms of the staple, bent as a U by the shaped disk into the peripheral recess 4 (wire transport 3 in effect serving as a mold), are folded neatly inwardly during the stapling process, these arms are expediently adjusted beforehand so as to turn slightly inwardly. For this purpose, staple guide 12 is provided with a post-bending edge 15 in the area of its lower surface, facing stapling cylinder 1, under which surface passes the back or base of the staples bent in each case into the peripheral recess 4 of wire transport 3. As the wire transport 3 passes through, post-bending edge 15 penetrates deeper into the peripheral recess 4 of wire transport 3 than did the shaped disk 5. The post-bending edge is so designed that as the back 16 of the staple passes, the latter receives a slight nick 17 in its middle region; in so doing the arms 18, formed at right angles to the staple back, are correspondingly turned slightly inwardly towards each other, as can be clearly seen in FIG. 2.

For formation of the post-bending edge 15 there is, in the case of the embodiment on which FIGS. 1, 3, and 4 are based, a shoe 21 provided which is mounted in a vertically adjustable manner in a chamber 20 of staple guide 12. Shoe 21 is secured by a screw 23 reaching through an oblong hole 22 in the chamber wall; this can best be seen in FIG. 4. Shoe 21 is so positioned that its axis 24, when compared with a corresponding radius of stapling cylinder 1, slants slightly in the rotational direction of stapling cylinder 1; in other words, it does not intersect the axis of the stapling cylinder. This has the effect that the front edge, with respect to the rotational direction of stapling cylinder 1, of the shoe 21 forming the post-bending edge moves further out of staple guide 12 than does its opposite or rear edge; at the same time a sloping face 25, increasing gradually to the full depth of the post-bending edge 15, results. Shoe 21 advantageously exhibits a shape which is symmetrical about its axis 24. This not only facilitates assembly but it also makes it possible, in a desirable manner, to increase by a multiple the sevice life of the shoe by simply turning it around. For ease of manufacture shoe 21, as can be clearly seen in FIG. 3, is simply provided in the areas of its anterior and posterior flanks with pointed covering surfaces 26, which greatly facilitates fitting the shoe 21 into chamber 20 (chamber 20 being formed expediently by means of milling).

On the stapling cylinder side, as is best seen in FIG. 4, shoe 21 is chamfered to provide lateral inclinations or faces 27, so that the post-bending edge 15 is formed by a narrow middle ridge. This results in a neat middle kink being formed in the staples as they pass under the post-bending edge. The limiting surface, opposite the post-bending edge 15, of the peripheral recess 4 in wire transport 3, in other words, the anterior end of a staple ejector 28, accommodated in wire transport 3, for ejecting the staples, is expediently profiled so as to correspond with the profiling of post-bending edge 15, as is shown in FIG. 4 by 29. In simple cases, however, it suffices if there is adequate space between the anterior end of staple ejector 28 and the back of the staple to enable the latter to undergo a corresponding kinking. In order to make space available for the inward-turning tendency of the arms of the staple when the back thereof is kinked, staple guide 12 can be provided in the region of its lateral surfaces with corresponding recesses. In many cases, however, it is sufficient if staple guide 12 measures slightly less than the inside width of the peripheral recess 4 in wire transport 3, as can be seen from FIG. 4.

In the embodiment shown in FIG. 5, a rotatably-mounted disk 31 is provided instead of shoe 21. The rotation of the disk results automatically in a gradual increase in the post-bending edge, here formed by the disk periphery and likewise denoted by numeral 15. It is expedient if, in order to narrow down the post-bending edge 15, the disk 31 is chamfered to give lateral inclinations or faces 32. For vertical adjustment, disk 31 is mounted on an eccentric pin 33 which, by means of a screw 34 which passes through a correspondingly slotted arm 35 of the eccentric pin 33, is secured against twisting at the staple guide 12.

While only several embodiments of the present invention have been shown and described, it will be obvious that many modifications and changes may be made thereinunto, without departing from the spirit and scope of the invention.

What is claimed is:

1. In a stapling machine of the type including at least one rotatable stapling cylinder having a wire transport and a peripheral recess formed therein, a shaped disk disposed for cooperation with said cylinder which, for the formation of staples, has an outer periphery which projects into the peripheral recess, and a fixed staple guide which, relative to the rotational direction of the stapling cylinder, is positioned after the shaped disk and which projects into the peripheral recess and has a surface which is underrun by a back of a finished staple, the improvement comprising:

said staple guide having, in the area of its surface which is underrun by the back of the finished staple, a post-bending edge which projects deeper into the peripheral recess than does the outer periphery of said shaped disk.

2. The stapling machine according to claim 1, wherein said post-bending edge tapers in the direction of deformation.

3. The stapling machine according to claim 1, wherein said post-bending edge has a sloping face rising in the direction of deformation.

4. The stapling machine according to claim 1, additionally including means for adjusting the depth of penetration of the post-bending edge into said recess.

5. The stapling machine according to claim 1, wherein said post-bending edge is formed by a shoe which is mounted in a vertically adjustable manner in a chamber of said staple guide, said shoe having an axis which, relative to a radial projection of said stapling cylinder, slants in the direction of rotation.

6. The stapling machine according to claim 5, wherein said shoe is symmetrical about its axis, and it has front and rear ends which are chamfered to provide inclined faces.

7. The stapling machine according to claim 1 wherein said post-bending edge is formed by a disk, rotatably mounted on an eccentric pin, and disposed in a chamber of the staple guide, said disk having a peripheral surface which is chamfered to provide lateral inclined faces.

8. The stapling machine according to claim 1, wherein said staple guide has a width slightly less than the inside width of said peripheral recess.

9. The stapling machine according to claim 1, additionally including a staple ejector positioned in said wire transport which exhibits in the area of an anterior end thereof facing a finished staple, a contour corresponding to that of said post-bending edge.

* * * * *